US011843910B2

(12) United States Patent
Emura

(10) Patent No.: US 11,843,910 B2
(45) Date of Patent: Dec. 12, 2023

(54) SOUND-SOURCE SIGNAL ESTIMATE APPARATUS, SOUND-SOURCE SIGNAL ESTIMATE METHOD, AND PROGRAM

(71) Applicant: NIPPON TELEGRAPH AND TELEPHONE CORPORATION, Tokyo (JP)

(72) Inventor: Satoru Emura, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 154 days.

(21) Appl. No.: 17/292,687

(22) PCT Filed: Jun. 28, 2019

(86) PCT No.: PCT/JP2019/025835
§ 371 (c)(1),
(2) Date: May 10, 2021

(87) PCT Pub. No.: WO2020/100340
PCT Pub. Date: May 22, 2020

(65) Prior Publication Data

US 2022/0014843 A1 Jan. 13, 2022

(30) Foreign Application Priority Data

Nov. 12, 2018 (JP) ..... 2018-212009

(51) Int. Cl.
*H04R 1/32* (2006.01)
*H04R 5/027* (2006.01)
(Continued)

(52) U.S. Cl.
CPC ..... *H04R 1/326* (2013.01); *H04R 1/028* (2013.01); *H04R 1/406* (2013.01); *H04R 3/005* (2013.01);
(Continued)

(58) Field of Classification Search
CPC . H04S 7/301; H04S 7/304; H04S 7/30; H04S 2420/01; H04S 2400/15;
(Continued)

(56) References Cited

U.S. PATENT DOCUMENTS 6,785,391 B1 * 8/2004 Emura ..... H04S 7/301 381/63
2009/0063605 A1 * 3/2009 Nakajima ..... G06F 17/15 708/422
(Continued)

FOREIGN PATENT DOCUMENTS

JP 2006148453 A * 6/2006

OTHER PUBLICATIONS

Dubnov, Speech source separation in convolutive environments using space time frequency analysis (Year: 2006).*
(Continued)

*Primary Examiner* — Joseph Saunders, Jr.
*Assistant Examiner* — Kuassi A Ganmavo

(57) ABSTRACT

The transfer function estimation device includes: a correlation matrix computing unit 43 computing a correlation matrix of N frequency domain signals y(f,l); a signal space basis vector computing unit 44 obtaining M vectors $v_1(f), \ldots, v_M(f)$ from eigenvectors of the correlation matrix from highest in the order of corresponding eigenvalues; and a plural RTF estimation unit 45 determining $t_i(f), \ldots, t_M(f)$ that satisfy the relationship of Expression (1), determining a matrix D(f) that is not a zero matrix and that makes $u_i(f), \ldots, u_M(f)$ defined by Expression (2) sparse in a time direction, determining $c_{i,1}(f), \ldots, c_{M,N}(f)$ that satisfy the relationship of Expression (3), and outputting $c_1(f)/c_{1,j}(f), \ldots, c_M(f)/c_{M,j}(f)$ as a relative transfer function, where j is an integer of 1 or more and not more than N.

9 Claims, 6 Drawing Sheets

(51) Int. Cl.

| | |
|---|---|
| ***H04R 1/40*** | (2006.01) |
| ***H04S 7/00*** | (2006.01) |
| ***H04R 1/02*** | (2006.01) |
| ***H04R 3/00*** | (2006.01) |

(52) U.S. Cl.
CPC ..... *H04R 5/027* (2013.01); *H04R 2201/401* (2013.01); *H04R 2499/15* (2013.01); *H04S 7/30* (2013.01); *H04S 7/301* (2013.01); *H04S 7/304* (2013.01); *H04S 2400/15* (2013.01); *H04S 2420/01* (2013.01)

(58) Field of Classification Search
CPC ..... H04R 1/326; H04R 3/005; H04R 5/027; H04R 1/028; H04R 1/406; H04R 2201/401; H04R 2499/15; H04R 2430/23
See application file for complete search history.

(56) References Cited

U.S. PATENT DOCUMENTS

2010/0054489 A1* 3/2010 Nakajima ..... H04S 1/002 381/66
2010/0208904 A1* 8/2010 Nakajima ..... H04R 1/406 381/66
2013/0096922 A1* 4/2013 Asaei ..... G10L 21/0308 704/E11.001
2014/0056435 A1* 2/2014 Kjems ..... G10L 15/20 381/317
2014/0244214 A1* 8/2014 Boufounos ..... G06F 18/21345 702/189
2017/0178664 A1* 6/2017 Wingate ..... G10L 25/30

OTHER PUBLICATIONS

Habets et al, An iterative mutichannel subspace based covariance subtraction method for relative transfer function estimation (Year: 2017).*
Johnson et al. (1993) "Array Signal Processing:Concepts and Techniques" Simon & Schuster, Inc., Saddle River, NJ.
Gannot et al. (2001) "Signal Enhancement Using Beamforming and Nonstationarity with Applications to Speech" IEEE Trans. Signal processing, vol. 49, No. 8, pp. 1614-1626.
Markovich et al. (2009) "Multichannel Eigenspace Beamforming in a Reverberant Noisy Environment With Multiple Interfering Speech Signals" IEEE Transactions on Audio, Speech, and Language Processing, vol. 17, No. 6, pp. 1071-1086.
Araki et al. (2007) "Blind speech separation in a meeting situation with maximum SNR beamformers" ICASSP, pp. 41-44.
Warsitz et al. (2007) "Blind Acoustic Beamforming Based on Generalized Eigenvalue Decomposition" IEEE Transactions on Audio, Speech, and Language Processing, vol. 15, No. 5, pp. 1529-1539.

* cited by examiner

SOUND-SOURCE SIGNAL ESTIMATE APPARATUS, SOUND-SOURCE SIGNAL ESTIMATE METHOD, AND PROGRAM

CROSS-REFERENCE TO RELATED APPLICATIONS

This application is a U.S. 371 Application of International Patent Application No. PCT/JP2019/025835, filed on 28 Jun. 2019, which application claims priority to and the benefit of JP Application No. 2018-212009, filed on 12 Nov. 2018, the disclosures of which are hereby incorporated herein by reference in their entireties.

TECHNICAL FIELD

This invention relates to a technique for estimating transfer functions.

BACKGROUND ART

There are growing needs recently to remove noise and other sounds from a multi-channel microphone signal acquired by a plurality of microphones set in a sound field so that a target speech or sound is clearly extracted. For this purpose, beamforming techniques that use a plurality of microphones to form a beam have been actively researched and developed in recent years.

Beamforming allows for clearer extraction of a target sound by largely reducing noises, which is achieved by applying an FIR filter 11 to each microphone signal and obtaining a total sum as illustrated in FIG. 1. The Minimum Variance Distortionless Response method (MVDR method) is often used as a method for determining such beamforming filters (see, for example, NPL1).

Below, this MVDR method will be explained with reference to FIG. 2. The MVDR method uses relative transfer functions $g_r(f)$ (hereinafter abbreviated to RTF) between the target sound source and each microphone estimated and given beforehand (see, for example, NPL 2).

An N-channel microphone signal $y_n(k)$ ($1 \le n \le N$) from a microphone array 21 is subjected to short-time Fourier transform for each frame in a short-time Fourier transform unit 22. The conversion results with frequency f and frame 1 are handled as a vector as follows.

$$y(f,l)=\begin{bmatrix} Y_1(f,l) \\ \vdots \\ Y_N(f,l) \end{bmatrix} \quad \text{[Formula 1]}$$

This N-channel signal y(f,l) is as the following:

$$y(f,l)=x(f,l)+x_n(f,l) \quad \text{[Formula 2]}$$

which is composed of a multi-channel signal x(f,l) originating from the target sound, and multi-channel signals $x_n(f,l)$ of non-target sounds.

A correlation matrix computing unit 23 computes a spatial correlation matrix R(f,l) with frequency f of the N-channel microphone signal by the following expression.

$$R(f,l)E[y(f,l)y^H(f,l)] \quad \text{[Formula 3]}$$

Here, E[ ] represents an expected value that is given. $y^H(f,l)$ represents a vector that is the complex conjugate of the transpose of y(f,l). In actual processing, normally, short-time average is used instead of E[ ].

An array filter estimation unit 24 solves the following constrained optimization problem to determine a filter coefficient vector h(f,l), which is an N-dimensional complex number vector.

$$h(f,l)=\text{argmin } h^H(f,l)R(f,l)h(f,l) \quad \text{[Formula 4]}$$

The constraint here is as follows.

$$h^H(f,l)g_r(f,l)=1 \quad \text{[Formula 5]}$$

The above optimization problem determines the filter coefficient vector such as to minimize the power of the array output signal in the presence of the constraint that the target sound is output without distortion at frequency f.

An array filtering unit 25 applies the estimated filter coefficient vector h(f,l) to the microphone signal y(f,l) converted to the frequency domain.

$$Z(f,l)=h^H(f,l)y(f,l) \quad \text{[Formula 6]}$$

This way, components other than the target sound are suppressed as much as possible and the target sound in the frequency domain Z(f,l) can be extracted.

An inverse short-time Fourier transform unit 26 performs the inverse short-time Fourier transform on the target sound Z(f,l). This way, target sound in the time domain can be extracted.

The target sound in the case where the estimated RTF is used as in NPL 2 is not the sound from the target sound source itself but the sound from the target sound source propagated through acoustic paths and picked up by a reference microphone.

In another conventional methods of estimating RTFs, it is proposed to estimate an RTF using eigenvalue decomposition or generalized eigenvalue decomposition of the pickup signal in a condition in which non-target sounds are negligible and it can be assumed that the sound comes from the target alone, i.e., in a condition in which a single source model is applicable (for example, see NPLs 2 and 3).

FIG. 3 illustrates this method. The processing performed by a microphone array 31 and a short-time Fourier transform unit 32 are similar to the processing performed by the microphone array 21 and the short-time Fourier transform unit 22 of FIG. 2.

The correlation matrix computing unit 33 computes an N×N correlation matrix at each frequency from the N-channel pickup signal of the period to which the single source model is applicable.

A signal space basis vector computing unit 34 decomposes this correlation matrix into eigenvectors and eigenvalues and determines an N-dimensional eigenvector having an absolute value corresponding to its maximum eigenvalue:

$$v(f)=[V_1(f) \ldots V_N(f)]^T \quad \text{[Formula 7]}$$

as the signal space basis vector v(f). Here, $a^T$ represents the transpose of a, where a is any vector or matrix. When there is one sound source, only one of the eigenvalues of the correlation matrix has significance, the remaining N−1 eigenvalues being substantially 0. The eigenvector of this significant eigenvalue contains information relating to the transfer characteristics between the sound source and each microphone.

When the first microphone is the reference microphone, the RTF computing unit 35 outputs v'(f) defined by the following expression as the RTF.

$$v'(f) = \left[1, \frac{V_2(f)}{V_1(f)}, \ldots \frac{V_N(f)}{V_1(f)}\right]^T \quad \text{[Formula 8]}$$

For a situation where sounds are output simultaneously from a plurality of sound sources, it is assumed that each source signal is sparse on the spectrogram like a speech signal. It is also supposed that the spectra of the source signals do not interfere or overlap each other at each frequency of each time point on the pickup signal spectrogram. Based on this supposition, an RTF can be estimated by applying a single sound source model (see, for example, NPLs 4 and 5).

CITATION LIST

Non Patent Literature

[NPL 1] D. H. Johnson, D. E. Dudgeon, Array Signal Processing, Prentice HalL1993.

[NPL 2] S. Gannot, D. Burshtein, and E. Weinstein, Signal Enhancement Using Beamforming and Nonstationarity with Applications to Speech, IEEE Trans. Signal processing, 49, 8, pp. 1614-1626, 2001.

[NPL 3] S. Markovich, S. Gannot, and I. Cohen, Multichannel Eigenspace Beamforming in a Reverberant Noisy Environment With Multiple Interfering Speech Signals, IEEE Trans. On Audio, Speech, Lang., 17, 6, pp. 1071-1086, 2009.

[NPL 4] S. Araki, H. Sawada, and S. Makino, Blind speech separation in a meeting situation with maximum SNR beamformer, in proc. IEEE Int. Conf. Acoust. Speech Signal Process. (ICASSP2007), 2007, pp. 41-44.

[NPL 5] E. Warsitz, R. Haeb-Umbach, Blind Acoustic Beamforming Based on Generalized Eigenvalue Decomposition, IEEE Trans. Audio, Speech, Lang., 15, 5, pp. 1529-1539, 2007.

SUMMARY OF THE INVENTION

Technical Problem

However, when several speakers talk in a room with high reverberation, for example, there may occur a situation where the spectra of different speakers overlap on the spectrogram because of the reverberation. Namely, the adaptability of the single source model may possibly be decreased due to reverberation.

Accordingly an object of the present invention is to provide a device, method, and program for estimating transfer functions that allow for estimation of RTFs even in a situation where the spectra of several speakers may overlap.

Means for Solving the Problem

The transfer function estimation device according to one aspect of this invention includes: a correlation matrix computing unit that computes a correlation matrix of N frequency domain signals y(f,l) corresponding to N time domain signals picked up by N microphones that form a microphone array, where N is an integer of 2 or more, f is a frequency index, and l is a frame index; a signal space basis vector that computes unit obtaining M vectors $v_1(f), \ldots, v_M(f)$ from eigenvectors of the correlation matrix from highest in an order of corresponding eigenvalues, where M is an integer of 2 or more; and a plural RTF estimation unit that determines $t_i(f), \ldots, t_M(f)$ that satisfy a relationship of:

$$Y(f, l) = [v_1(f), \ldots, v_M(f)] \begin{bmatrix} t_1(f) \\ \vdots \\ t_M(f) \end{bmatrix}, \quad \text{[Formula 9]}$$

where Y(f,l)=[y(f,l+1), . . . , y(f,l+L)], L being an integer of 2 or more, $$\begin{bmatrix} u_1(f) \\ \vdots \\ u_M(f) \end{bmatrix} = D(f) \begin{bmatrix} t_1(f) \\ \vdots \\ t_M(f) \end{bmatrix} \quad \text{[Formula 10]}$$

determines a matrix D(f) that is not a 0 matrix and that makes $u_i(f), \ldots, u_M(f)$ defined by an expression above sparse in a time direction, determining $c_{i,1}(f), \ldots, c_{M,N}(f)$ that satisfy a relationship of:

$$[c_1(f), \ldots, c_M(f)] = [v_1(f), \ldots, v_M(f)]D^{-1}(f)$$

$$c_i(f) = [c_{i,1}(f), \ldots, c_{i,N}(f)]^T i = 1, \ldots, M, \quad \text{[Formula 11]}$$

and outputs $c_1(f)/c_{1,j}(f), \ldots, c_M(f)/c_{M,j}(f)$ as a relative transfer function, where j is an integer of 1 or more and not more than N.

Effects of the Invention

RTFs can be estimated even in a situation where the spectra of several speakers may overlap.

DESCRIPTION OF EMBODIMENTS

Figure 1:
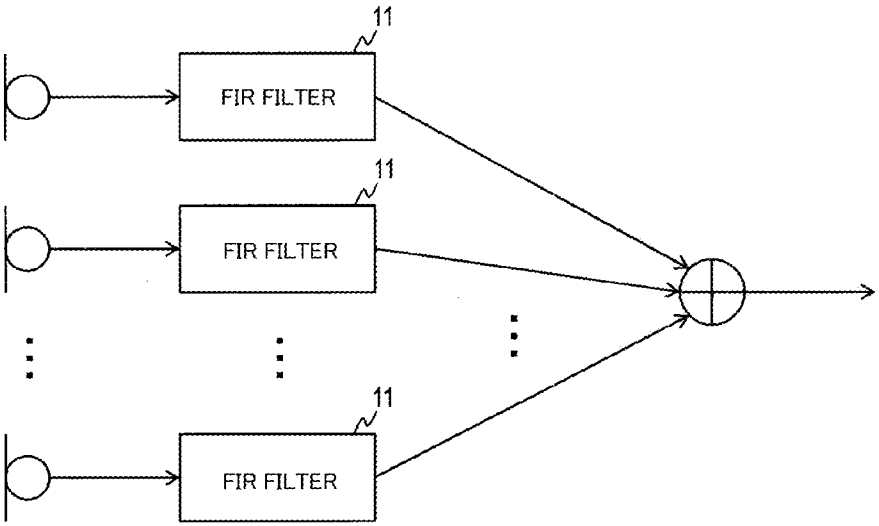
FIG. 1 is a diagram for explaining a beamforming technique.
Figure 2:
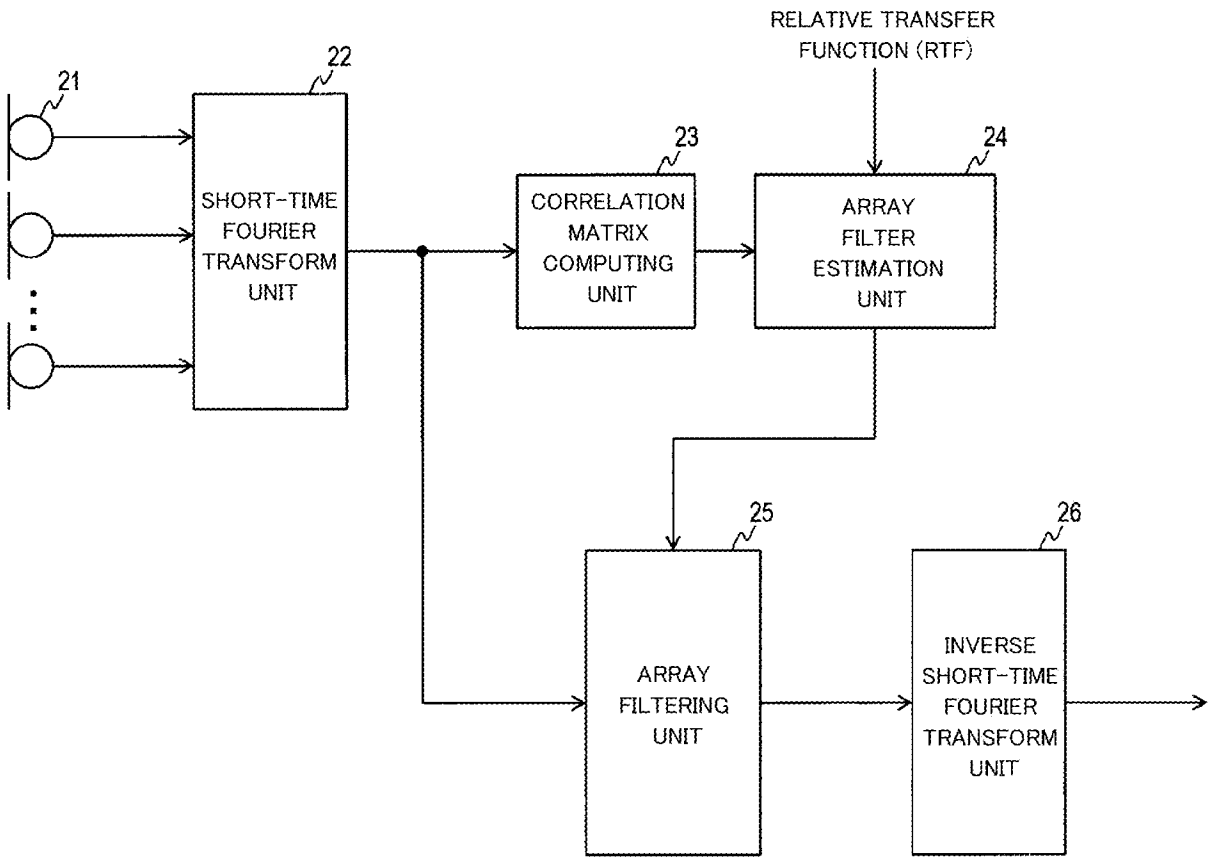
FIG. 2 is a diagram for explaining an MVDR method.
Figure 3:
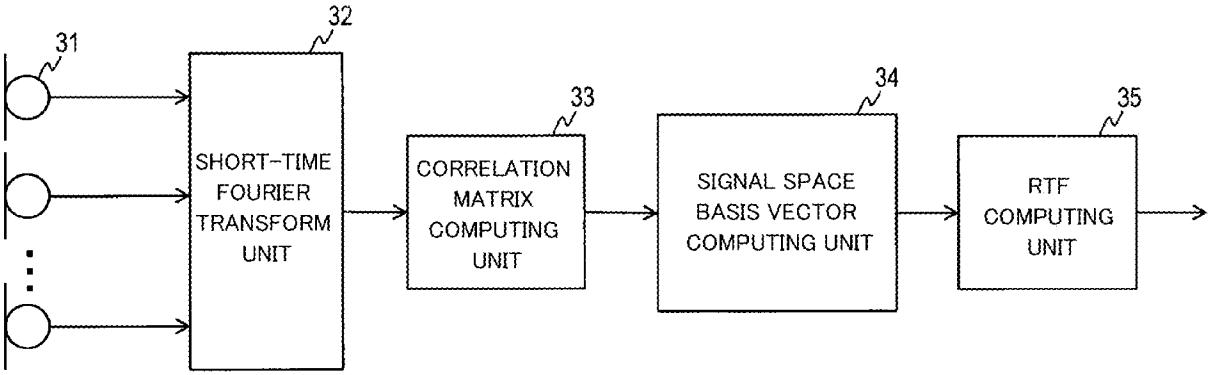
FIG. 3 is a diagram for explaining an existing technique for estimating an RTF.

Hereinafter, one embodiment of this invention will be described in detail. Constituent units having the same functions in the drawings are given the same reference numerals to omit repetitive description.

[Transfer Function Estimation Device and Method]

Figure 4:
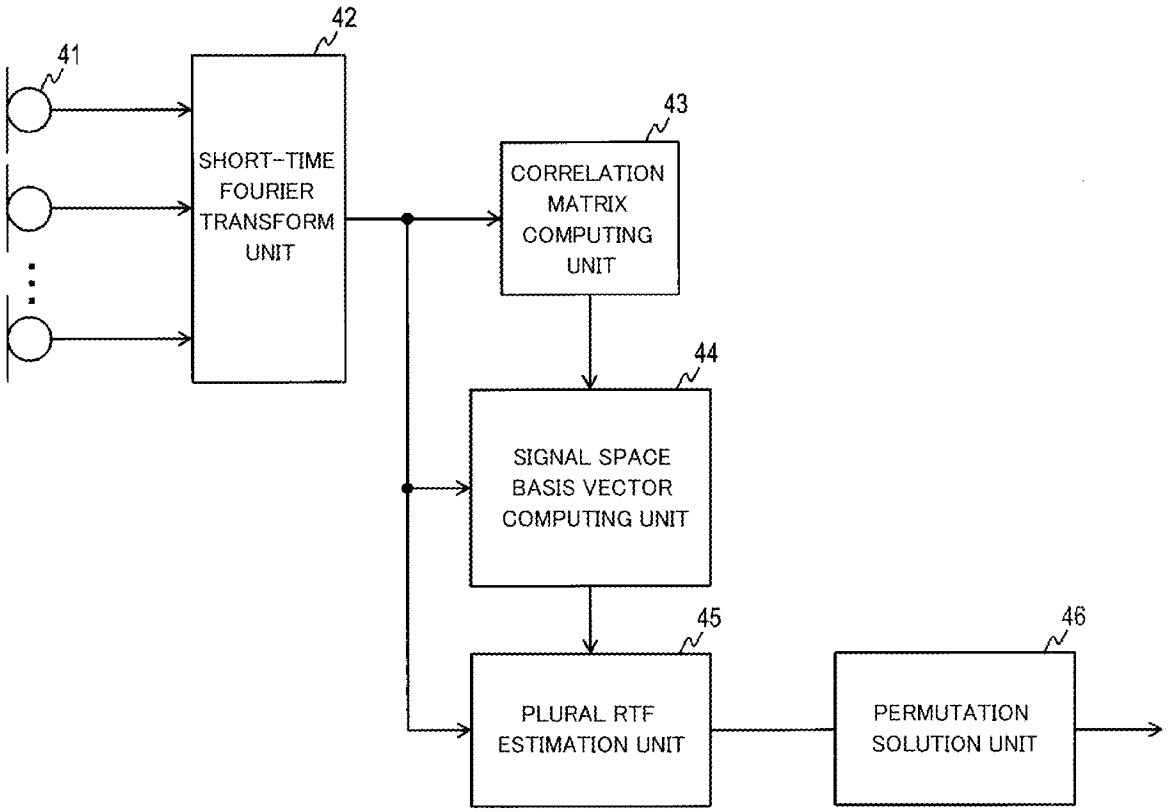
FIG. 4 is a diagram illustrating an example of a functional configuration of the transfer function estimation device of this invention.

The transfer function estimation device includes, as illustrated in FIG. 4, a microphone array 41, a short-time Fourier transform unit 42, a correlation matrix computing unit 43, a signal space basis vector computing unit 44, and a plural RTF estimation unit 45, for example.

Figure 5:
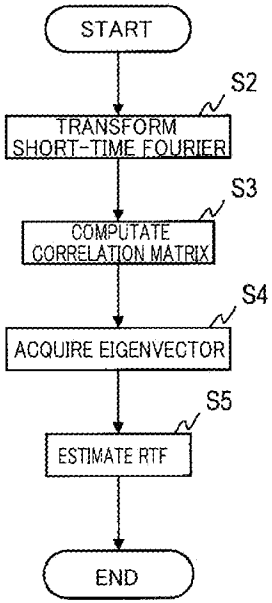
FIG. 5 is a diagram illustrating an example of processing steps of the transfer function estimation method of this invention.

The transfer function estimation method is realized, for example, by each of the constituent units of the transfer function estimation device performing the processing from step S2 to step S5 described below and illustrated in FIG. 5.

Below, the constituent units of the transfer function estimation device will each be described.

The microphone array 41 is configured by N microphones. N is any integer of 2 or more. The time domain signal picked up by each microphone is input to the short-time Fourier transform unit 42.

The short-time Fourier transform unit 42 performs short-time Fourier transform on each input time domain signal to generate a frequency domain signal y(f,l) (step S2). Here, f is the frequency index, and l is the frame index. y(f,l) represents an N-dimensional vector having N elements of frequency domain signals $Y_1(f,l), \ldots, Y_N(f,l)$ corresponding to N time domain signals picked up by N microphones. The generated frequency domain signals y(f,l) are output to the correlation matrix computing unit 43, signal space basis vector computing unit 44, and plural RTF estimation unit 45.

When the number of sound sources is M that is an integer of 2 or more and not more than N, the frequency domain signal y(f,l) is expressed as follows, where M=2, for example. The number of sound sources M is predetermined based on other information such as a video image or the like. Alternatively, the number of sound sources M may be obtained by the method described in NPL 2, or by estimating the number of significant eigenvalues from the distribution of a correlation matrix's eigenvalues. The number of sound sources M may be obtained by any existing methods such as the one described in NPL 2.

[Formula 12]

$$y(f,l)=g_1(f)s_1(f,l)+\ldots+g_M(f)s_M(f,l) \quad (1)$$

Here, $S_i(f,l)$ represents the sound of the i-th sound source, where i=1, . . . , M, and $g_i(f)$ represents the transfer characteristic from the i-th sound source to each of the microphones forming the microphone array 1.

The correlation matrix computing unit 43 computes a correlation matrix of the frequency domain signal y(f,l) that is a pickup signal containing a mixture of speeches of several speakers (step S3). More particularly, the correlation matrix computing unit 43 computes a correlation matrix of N frequency domain signals y(f,l) corresponding to N time domain signals picked up by the N microphones that form the microphone array. The computed correlation matrix is output to the signal space basis vector computing unit 44.

The correlation matrix computing unit 43 computes the correlation matrix by the processing similar to that of the correlation matrix computing unit 23, for example.

The signal space basis vector computing unit 44 decomposes the correlation matrix into eigenvectors and eigenvalues, and obtains eigenvectors $v_1(f), \ldots, v_M(f)$ in the same number as the number of sound sources M, from highest in the order of absolute values of the eigenvalues (step S4). In other words, the signal space basis vector computing unit 44 obtains M vectors $v_1(f), \ldots, v_M(f)$ from the eigenvectors of the correlation matrix from highest in the order of corresponding eigenvalues.

The expression (1) defines that the frequency domain signal y(f,l) that is an N-dimensional signal vector necessarily exits in the space spanned by the M vectors $g_1(f), \ldots, g_M(f)$. Eigendecomposition of the correlation matrices of the frequency domain signals y(f,l) produces only M eigenvalues with significantly large absolute values, the remaining N-M eigenvalues being substantially 0. The space spanned by the vectors $g_1(f), \ldots, g_M(f)$ conforms to the space spanned by $v_1(f), \ldots, v_M(f)$. There is hardly any one-to-one correspondence between $g_1(f), \ldots, g_M(f)$ and $v_1(f), \ldots, v_M(f)$, but each of $g_1(f), \ldots, g_M(f)$ is expressed by the linear sum of $v_1(f), \ldots, v_M(f)$ (see, for example, Reference Literature 1).

[Reference Literature 1] S. Malkovich, S. Gannot, and I. Cohen, Multichannel Eigenspace Beamforming in a Reverberant Noisy Environment With Multiple Interfering Speech Signals, IEEE Trans. On Audio, speech, Lang., 17, 7, pp. 1071-1086, 2009.

The plural RTF estimation unit 5 estimates the RTFs by extracting the information of this linear sum.

More specifically, the plural RTF estimation unit 45 first decomposes Y(f,l), which is composed of frequency domain signals y(f,l) of continuous L frames where L is an integer of 2 or more:

$$Y(f,l)=[y(f,l+1), \ldots, y(f,l+L)], \quad \text{[Formula 13]}$$

using the eigenvectors $v_1(f), \ldots, v_M(f)$ extracted by the signal space basis vector computing unit 44 into the following formula:

$$Y(f,l) \rightarrow [v_1(f), \ldots, v_M(f)]\begin{bmatrix} t_1(f) \\ \vdots \\ t_M(f) \end{bmatrix} \quad \text{[Formula 14]}$$

Here, $t_i(f)$, where i=1, . . . , M, represents a 1×L vector computed by the following formula.

$$t_i(f)=v_i^H(f)Y(f,l) \quad \text{[Formula 15]}$$

Here, v being a given vector, $v^H$ is a vector that is the complex conjugate of the transpose of v.

Suppose, $t_i(f), \ldots, t_M(f)$ are converted into $u_1(f), \ldots, u_M(f)$ by an M×M matrix D(f). Assuming that the source signal is a voice signal, for example, the sparsity of the signal is reduced when voices are mixed together. If, then, D(f) that makes $u_1(f), \ldots, u_M(f)$ as sparse as possible in the time direction is determined, it is expected that $u_1(f), \ldots, u_M(f)$ will be closer to respective speakers' voices before mixed together.

Therefore, the sparsity of $u_1(f), \ldots, u_M(f)$ is measured with an L1 norm to obtain a cost function. The plural RTF estimation unit 45 solves the following optimization problem:

$$\text{Minimize}|u_1(f)|_1+\ldots+|u_M(f)|_1 \quad \text{[Formula 16]}$$

$$\begin{bmatrix} u_1(f) \\ \vdots \\ u_M(f) \end{bmatrix} = D(f)\begin{bmatrix} t_1(f) \\ \vdots \\ t_M(f) \end{bmatrix}$$

under the following constraint:

$$D_{i,1}(f)=1(i=1, \ldots, M) \quad \text{[Formula 17]}$$

to determine D(f). Here, by restricting the diagonal elements of D(f) to 1, D(f) is prevented from becoming a 0 matrix. The diagonal elements of D(f) may be restricted to other predetermined values than 1. In this case, the diagonal elements may each be different. Namely, there may be i, j∈[1, . . . , M] where $$D_{i,j}(f)\neq D_{i,j}(f). \quad \text{[Formula 18]}$$

With the main diagonal elements of D(f) set to a predetermined value like this, the plural RTF estimation unit determines D(f) that minimizes $|u_1(f)|_1 + \ldots + |u_M(f)|_1$. Since this optimization problem is a convex function, there is only one solution.

Using the 1×L matrix $S_i(f,l)$ of the source signal $$S_i(f,l)=[s_i(f,l+1), \ldots, s_i(f,l+L)](i=1, \ldots, M), \quad \text{[Formula 19]}$$

Y(f,l) can be written as follows.

$$Y(f,l) = [v_1(f), \ldots, v_M(f)]\begin{bmatrix} t_1(f) \\ \vdots \\ t_M(f) \end{bmatrix} = [v_1(f), \ldots, v_M(f)]\begin{bmatrix} u_1(f) \\ \vdots \\ u_M(f) \end{bmatrix} = [g_1(f), \ldots, g_M(f)]\begin{bmatrix} S_1(f) \\ \vdots \\ S_M(f) \end{bmatrix} \quad \text{[Formula 20]}$$

This is defined as below.

$$[c_1(f), \ldots, c_M(f)]=[v_1(f), \ldots, v_M(f)]D^{-1}(f) \quad \text{[Formula 21]}$$

If the mixed voice signal is decomposed by D(f) favorably, $s_i(f)$ and $u_i(f)$, where i=1, . . . , M, will substantially match each other except for the scaling. Namely, it is expected that the directions of the vectors will be substantially aligned. At the same time, it is expected that the directions of $c_i(f)$ and $g_i(f)$, where i=1, . . . , M, will be substantially aligned, too. Accordingly, if:

$$c_i(f)=[c_{i,1}(f), \ldots, c_{i,N}(f)]^T, \quad \text{[Formula 22]}$$

where j is an integer of 1 or more and not more than N, the j-th microphone is the reference microphone, and i=1, . . . , M, then $c_i(f)/c_{i,1}(f)$ is the estimate of the relative transfer function relating to each sound source.

In this way, with L being an integer of 2 or more and Y(f,l)=[y(f,l+1), . . . , y(f,l+L)], the plural RTF estimation unit 45 determines $t_i(f), \ldots, t_M(f)$ that satisfy the relationship of the following.

$$Y(f,l) = [v_1(f), \ldots, v_M(f)]\begin{bmatrix} t_1(f) \\ \vdots \\ t_M(f) \end{bmatrix}. \quad \text{[Formula 23]}$$

$$\begin{bmatrix} u_1(f) \\ \vdots \\ u_M(f) \end{bmatrix} = D(f)\begin{bmatrix} t_1(f) \\ \vdots \\ t_M(f) \end{bmatrix} \quad \text{[Formula 24]}$$

Then, a matrix D(f) that is not a 0 matrix and that makes $u_i(f), \ldots, u_M(f)$ defined by the expression above sparse in the time direction is determined. Next, $c_{1,1}(f), \ldots, c_{M,N}(f)$ that satisfy the relationship of:

$$[c_1(f), \ldots, c_M(f)]=[v_1(f), \ldots, v_M(f)]D^{-1}(f)$$

$$c_i(f)=[c_{i,1}(f), \ldots, c_{i,N}(f)]^T i=1, \ldots, M \quad \text{[Formula 25]}$$

are determined. Then, $c_1(f)/c_{1,j}(f), \ldots, c_M(f)/c_{M,j}(f)$ are output, where j is an integer of 1 or more and not more than N, as a relative transfer function.

VARIATION EXAMPLE

In the optimization described above, when determining $u_1(f), \ldots, u_M(f)$ from the time-varying vectors $t_1(f), \ldots, t_M(f)$ with the matrix D(f), D(f) is determined such as to make $u_1(f), \ldots, u_M(f)$ sparsest in the time direction. For this purpose, the sparsity of $u_1(f), \ldots, u_M(f)$ is measured with L1 norms.

However, the L1 norm used in this way reduces not only when $u_1(f), \ldots, u_M(f)$ become sparse in the time direction but also when the amplitudes of $u_1(f), \ldots, u_M(f)$ become smaller. Therefore, minimization of the L1 norm does not necessarily always provide a sparsest signal.

To achieve a sparse signal more reliably, therefore, D(f) is determined such as to make the signal $u_1(f), \ldots, u_M(f)$ sparsest under a constraint that the signal power of the signal $u_1(f), \ldots, u_M(f)$ is constant.

Specifically, the plural RTF estimation unit 45 first regularizes the time-varying vectors $t_1(f), \ldots, t_M(f)$ so that their respective L2 norms become 1 to obtain normalized time-varying vectors. Namely, plural RTF estimation unit 45 calculates $t_{ni}(f)=t_i(f)/\|t_i(f)\|_2$, where i=1, . . . , M. $\|t_i(f)\|_2$ is the L2 norm of $t_i(f)$. The normalized time-varying vectors are expressed as $(t_{n1}(f), \ldots, t_{nM}(f))$.

Next, the plural RTF estimation unit 45 solves the optimization problem that uses the L1 norm as a cost function to determine a matrix A. Namely, the plural RTF estimation unit 45 determines the matrix A that minimizes $|u_1(f)|_1 + \ldots, +|u_M(f)|_1$ and that satisfies the following condition, using $t_{n1}(f), \ldots, t_{nM}(f)$.

$$\begin{bmatrix} u_1(f) \\ \vdots \\ u_M(f) \end{bmatrix} = A\begin{bmatrix} t_{n1}(f) \\ \vdots \\ t_{nM}(f) \end{bmatrix} \quad \text{[Formula 26]}$$

$$A^H A = I_M$$

Here, $A^H$ is the Hermitian matrix of the matrix A, and $I_M$ is an M×M unit matrix. Here, each element of the matrix A can be described as follows. Each element of the matrix A may also be called the coefficient.

$$A = \begin{bmatrix} \alpha_{1,J} & \ldots & \alpha_{1,M} \\ \vdots & \ddots & \vdots \\ \alpha_{M,1} & \ldots & \alpha_{M,M} \end{bmatrix} \quad \text{[Formula 27]}$$

This optimization problem can be solved by applying a method called Alternating Direction Method of Multipliers (ADMM) method (see, for example, Reference Literature 2).

[Reference Literature 2] S. Boyd, N. Parikh, E. Chu, B. Peleato and J. Eckstein, "Distributed Optimization and Statistical Learning via the Alternating Direction Method of Multipliers, Foundations and Trends in Machine Learning", Vol. 3, No. 1 (2010) 1-122.

Using the matrix A, the sparsest signal is expressed as follows.

$$\begin{bmatrix} u_1(f) \\ \vdots \\ u_M(f) \end{bmatrix} = A\begin{bmatrix} t_{n1}(f) \\ \vdots \\ t_{nM}(f) \end{bmatrix} = \begin{bmatrix} 1/\|t_1(f)\|_2 & 0 & 0 \\ 0 & \ddots & 0 \\ 0 & 0 & 1/\|t_M(f)\|_2 \end{bmatrix}\begin{bmatrix} t_1(f) \\ \vdots \\ t_M(f) \end{bmatrix} \quad \text{[Formula 28]}$$

Here, if:

$$d(f) = A\begin{bmatrix} 1/\|t_1(f)\|_2 & 0 & 0 \\ 0 & \ddots & 0 \\ 0 & 0 & 1/\|t_M(f)\|_2 \end{bmatrix}, \quad \text{[Formula 29]}$$

then the relationship $$Y(f, l) = [v_1(f), \ldots, \quad \text{[Formula 30]}$$

$$v_M(f)]\begin{bmatrix} t_1(f) \\ \vdots \\ t_M(f) \end{bmatrix} = [v_1(f), \ldots, v_M(f)]$$

$$D^{-1}(f)\begin{bmatrix} u_1(f) \\ \vdots \\ u_M(f) \end{bmatrix} = [g_1(f), \ldots, g_M(f)]\begin{bmatrix} S_1(f) \\ \vdots \\ S_M(f) \end{bmatrix}$$

is established. Thus, by using the D(f) described above, the relative transfer function of each sound source can be estimated by the method similar to the foregoing.

Namely, using the determined D(f) and eigenvectors $v_1(f), \ldots, v_M(f)$, the plural RTF estimation unit 45 determines $c_{i,1}(f), \ldots, c_{M,N}(f)$ that satisfy the relationship of the following.

$$[c_1(f), \ldots, c_M(f)] = [v_1(f), \ldots, v_M(f)]D^{-1}(f)$$

$$c_i(f) = [c_{i,1}(f), \ldots, c_{i,N}(f)]^T i = 1, \ldots, M \quad \text{[Formula 31]}$$

Then, $c_1(f)/c_{1,j}(f), \ldots, c_M(f)/c_{M,j}(f)$ are output, where j is an integer of 1 or more and not more than N, as a relative transfer function.

The pickup signal contains noise, so that the time-varying vectors $t_1(f), \ldots, t_M(f)$ calculated from the pickup signal also contain noise-originated components as well as source-originated components.

In the method described above, the time-varying vectors are regularized. Therefore, the norms of $t_1(f), \ldots, t_M(f)$ take various values depending on the circumstance. Looking at a particular frequency f, when there are equal amounts of the component of the first sound source and the component of the m-th sound source, the norms of $t_1(f), \ldots, t_M(f)$ show close values. Here, m is an integer from 2 to M.

When, however, the component of the second sound source is significantly smaller than that of the first sound source, for example, the norm of $t_2(f)$ becomes very small as compared to $t_1(f)$. In such a case, the normalized time-varying vector $t_{n2}(f)$, which is regularized $t_2(f)$, may contain only a very small component originating from the second sound source, other components being mostly noises.

Using such $t_{n2}(f)$ may possibly cause large deterioration of the estimation of RTF.

For this reason, an upper limit may be provided to the coefficient related to the normalized time-varying vector $t_{n2}(f)$, when the norm of $t_2(f)$ is very small relative to $t_1(f)$, to inhibit deterioration of the RTF estimate.

The plural RTF estimation unit 45 determines such an upper limit in the following manner.

First, it is assumed that $t_1(f)$ and $t_2(f)$ each contain an equal amount of noise.

The plural RTF estimation unit 45 sets the norm ratios $\theta$, $\theta_2$ when normalizing the time-varying vectors as follows.

$$\theta_1 = \frac{\|t_{n1}(f)\|_2}{\|t_1(f)\|_2} \quad \text{[Formula 32]}$$

$$\theta_2 = \frac{\|t_{n2}(f)\|_2}{\|t_2(f)\|_2}$$

$t_1(f)$ and $t_2(f)$ are determined from the eigenvalues of the correlation matrix. Since the eigenvalue related to $t_1(f)$ is larger than the eigenvalue related to $t_2(f)$, $\|t_1(f)\|_2 \geq \|t_2(f)\|_2$. After the normalization, the norms are both 1, so that $\theta_1 \leq \theta_2$.

There is the following relationship, where $\Delta t_{n1}(f)$ and $\Delta t_{n2}(f)$ respectively represent the noise contained in the normalized time-varying vectors $(t_{n1}(f), t_{n2}(f))$.

$$\frac{\|\Delta t_{n1}(f)\|_2}{\|\Delta t_{n2}(f)\|_2} = \frac{\theta_1}{\theta_2} \quad \text{[Formula 33]}$$

Since $\theta_1 \leq \theta_2$, $\|\Delta t_{n2}(f)\|_2 \geq \|\Delta t_{n1}(f)\|_2$.

Now, when the sparse signal vector $u_1(f)$ is expressed using coefficients $\alpha_{1,1}$ and $\alpha_{1,2}$ as:

$$u_1(f) = \alpha_{1,1}t_{n1}(f) + \alpha_{1,2}t_{n2}(f), \quad \text{[Formula 34]}$$

the error contained in $u_1(f)$ is as follows.

$$|\alpha_{1,1}|^2\|\Delta t_{n1}(f)\|_2^2 + |\alpha_{1,2}|^2\|\Delta t_{n2}(f)\|_2^2 \quad \text{[Formula 35]}$$

The size of the coefficient $\alpha_{1,2}$ is limited so that this is less than T times $\|t_{n1}(f)\|_2^2$. Namely, the upper limit of the coefficient $\alpha_{1,2}$ is set by:

$$|\alpha_{1,1}|^2\|\Delta t_{n1}(f)\|_2^2 + |\alpha_{1,2}|^2\|\Delta t_{n2}(f)\|_2^2 \leq T\|\Delta t_{n1}(f)\|_2^2 \quad \text{[Formula 36]}$$

$$|\alpha_{1,2}|^2 \leq (T - |\alpha_{1,1}|^2)\|\Delta t_{n1}(f)\|_2^2 / \|\Delta t_{n2}(f)\|_2^2 = (T - |\alpha_{1,1}|^2)\frac{\theta_1^2}{\theta_2^2}$$

$$|\alpha_{1,2}| \leq \sqrt{T - |\alpha_{1,1}|^2}\,\frac{\theta_1}{\theta_2},$$

where T is a predetermined positive number. It is desirable to use a value of 100 or more for T. Since $|\alpha_{1,1}| \ll T$, the upper limit may be specified by the following instead of the above.

$$|\alpha_{1,2}| \leq \sqrt{T}\,\frac{\theta_1}{\theta_2} \quad \text{[Formula 37]}$$

Providing an upper limit to the coefficient $\alpha_{1,2}$ related to the normalized time-varying vector $t_{n2}(f)$ this way increases the estimation accuracy of RTF.

When the number M of sound sources is larger than 2, the norm ratios $\theta_1, \theta_2, \ldots, \theta_M$ when normalizing time-varying vectors are given as:

$$\theta_1 = \frac{\|t_{n1}(f)\|_2}{\|t_1(f)\|_2} \quad \text{[Formula 38]}$$

$$\theta_2 = \frac{\|t_{n2}(f)\|_2}{\|t_2(f)\|_2}$$

$$\vdots$$

$$\theta_M = \frac{\|t_{nM}(f)\|_2}{\|t_M(f)\|_2},$$

and the m'-th ($1 \le m' \le M$) extracted signal is expressed by coefficients $\alpha_{m',1}, \ldots, \alpha_{m',M}$ as follows:

$$u_{m'}(f)=\alpha_{m',1}t_{n1}(f)+\alpha_{m',2}t_{n2}(f)+\ldots\alpha_{m',M}t_{nM}(f) \quad \text{[Formula 39]}$$

In this case, the plural RTF estimation unit 45 may determine the upper limit for the size of the coefficient $\alpha_{m',m}$ by the following.

$$|\alpha_{m',m}| \le \sqrt{T}\,\frac{\theta_1}{\theta_m}(2 \le m \le M) \quad \text{[Formula 40]}$$

When the number of sound sources is M, the plural RTF estimation unit 45 estimates relative transfer function vectors $c^m(f)=c_1(f)/c_{1,j}(f), \ldots, c_{m'}(f)/c_{m',j}(f), \ldots, c_M(f)/c_{M,j}(f)$, containing M elements of relative transfer functions, where m=1, . . . , M, at each frequency. The relative transfer function vector $c^m(f)$ is the m-th relative transfer function vector generated by the plural RTF estimation unit 45.

Here, the correspondence between the relative transfer functions from index 1 to index M to the sound sources, i.e., the correspondence between the indexes m' of $u_{m'}(f)$ ($1 \le m' \le M$) and the sound sources are not necessarily the same at any frequency. Therefore it is necessary to determine the index $\sigma(f,m)$ of the sound source for $u_{m'}(f)$ to correspond to at each frequency. This is called permutation solution.

A permutation solution unit 46 may perform this permutation solution. The permutation solution may be realized, for example, by the method described in Reference Literature 3.

[Reference Literature 3] H. Sawada, S. Araki, S. Makino, "MLSP 2007 Data Analysis Competition: Frequency-Domain Blind Source Separation for Convolutive Mixtures of Speech/Audio Signals", IEEE International Workshop on Machine Learning for Signal Processing (MLSP 2007), pp. 45-50, August 2007.

At a given frequency f, the relative transfer function vector $c^m(f)$ corresponds to $u_m(f)$. By permutation solution, this relative transfer function vector $c^m(f)$ corresponds to the $\sigma(f,m)$-th sound source.

While the embodiment and variation example have been described above, it should be understood that specific configurations are not limited to those of the embodiment and any design changes or the like made without departing from the scope of this invention shall be included in this invention.

Various processing steps described above in the embodiment may not only be executed in chronological order in accordance with the description, but also be executed in parallel or individually in accordance with the processing capacity of the device executing the processing, or in accordance with necessity.

[Program and Recording Medium]

Figure 6:
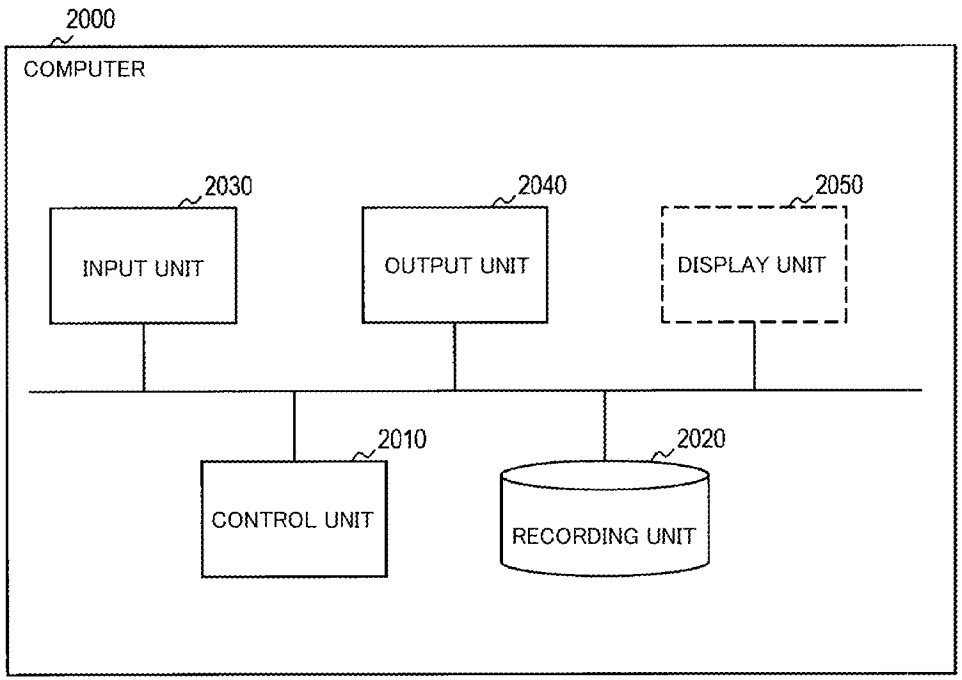
FIG. 6 is a diagram illustrating an example of a functional configuration of a computer.

When various processing functions of each of the devices described above are to be realized by a computer, the processing contents of the functions each device should have are described by a program. By executing this program on a computer, the various processing functions of each of the devices described above are realized on the computer. For example, the various processing steps described above may be performed by reading in a program to be executed to a recording unit 2020 of the computer illustrated in FIG. 6, and by causing the control unit 2010, input unit 2030, and output unit 2040, etc., to operate.

The program that describes the processing contents may be recorded on a computer-readable recording medium. Any computer-readable recording medium may be used, such as, for example, a magnetic recording device, an optical disc, an optomagnetic recording medium, a semiconductor memory, and so on.

This program may be distributed by selling, transferring, leasing, etc., a portable recording medium such as a DVD, CD-ROM and the like on which this program is recorded, for example. Moreover, this program may be distributed by storing the program in a memory device of a server computer, and by forwarding this program from the server computer to another computer via a network.

A computer that executes such a program may, for example, first temporarily store the program recorded on a portable recording medium or the program forwarded from a server computer, in a memory device of its own. In executing the processing, this computer reads out the program stored in its own memory device, and executes the processing in accordance with the read-out program. Moreover, as an alternative form of executing this program, the computer may read out this program directly from a portable recording medium and execute the processing in accordance with the program. Further, every time a program is forwarded from a server computer to this computer, the processing in accordance with the received program may be executed consecutively. In an alternative configuration, instead of forwarding the program from a server computer to this computer, the processing described above may be executed by a service known as ASP (Application Service Provider) that realizes processing functions only through instruction of execution and acquisition of results. It should be understood that the program in this embodiment includes information to be provided for the processing by an electronic calculator based on the program (such as data having a characteristic to define processing of a computer, though not direct instructions to the computer).

Note, instead of configuring the device by executing a predetermined program on a computer as in this embodiment, at least some of these processing contents may be realized by hardware.

REFERENCE SIGNS LIST

41 Microphone array

42 Short-time Fourier transform unit

43 Correlation matrix computing unit

44 Signal space basis vector computing unit

45 Estimation unit

The invention claimed is:

1. A transfer function estimation device comprising a processor configured to execute a method comprising:

determining a correlation matrix determiner configured to determine a correlation matrix of N frequency domain signals y(f, 1) corresponding to N time domain signals picked up by N microphones that form a microphone array, where N is an integer of 2 or more, f is a frequency index, and 1 is a frame index;

obtaining M vectors $_{v1}(f), \ldots {}_{vM}(f)$ from eigenvectors of the correlation matrix from highest in an order of corresponding eigenvalues, where M is an integer of 2 or more;

determining $t_i(f), \ldots t_M(f)$ that satisfy a relationship of:

$$Y(f, l) = v_1(f), \cdots, v_M(f)\begin{bmatrix} t_1(f) \\ \vdots \\ t_M(f) \end{bmatrix}, \quad \text{[Formula 41]}$$

where Y(f,1)=[y(f,1+1), y(f,1+L)], L being an integer of 2 or more;

$$\begin{bmatrix} u_1(f) \\ \vdots \\ u_M(f) \end{bmatrix} = D(f)\begin{bmatrix} t_1(f) \\ \vdots \\ t_M(f) \end{bmatrix} \quad \text{[Formula 42]}$$

determining a matrix D(f) that is not a zero matrix, wherein the matrix D(f) makes $u_i(f), \ldots, u_M(f)$ defined by an expression above sparse in a time direction;

determining $c_{i,1}(f), \ldots, c_{M,N}(f)$ that satisfy a relationship of:

$$[c_1(f), \ldots, c_M(f)] = [v_1(f), \ldots, v_M(f)]D^{-1}(f)$$
$$c_i(f) = [c_{i,1}(f), \ldots, c_{i,N}(f)]^T i = 1, \ldots, M \quad \text{[Formula 43]}$$

and outputting $c_1(f)/c_{1j}(f), \ldots, c_M(f)/c_{Mj}(f)$ as a relative transfer function, where j is an integer of 1 or more and not more than N; and extracting targeted audio data from an input audio received from the N microphones according to the relative transfer function.

2. The transfer function estimation device according to claim 1, wherein the determining the $t_i(f), \ldots t_M(f)$ further comprises determining a matrix D(f) that minimizes $|u_1(f)|_1 + \ldots + u_M(f)|_1$, in a condition in which diagonal elements of the matrix D(f) are fixed to a predetermined value.

3. The transfer function estimation device according to claim 1, wherein, where $A^H$ is a Hermitian matrix of a matrix A, $I_M$ is an M×M unit matrix, $\|t_i(f)\|_2$ is an L2 norm of $t_i(f)$, and $t_{ni}(f) = t_i(f)/\|t_i(f)\|_2$, where i=1, . . . , M, the processor further configured to execute a method comprising:

determining a matrix A that minimizes $|u_1(f)|_1 + \ldots + |u_M(f)|_1$, wherein the matrix A satisfies a following condition:

$$\begin{bmatrix} u_1(f) \\ \vdots \\ u_M(f) \end{bmatrix} = A\begin{bmatrix} t_{n1}(f) \\ \vdots \\ t_{nM}(f) \end{bmatrix} \quad \text{[Formula 44]}$$
$$A^H A = I_M,$$

and determining a matrix D(f) defined by a following expression:

$$D(f) = A\begin{bmatrix} 1/\|t_1(f)\|_2 & 0 & 0 \\ 0 & \ddots & 0 \\ 0 & 0 & 1/\|t_M(f)\|_2 \end{bmatrix}, \quad \text{[Formula 45]}$$

using the determined matrix A.

4. A transfer function estimation method comprising:

determining a correlation matrix of N frequency domain signals y(f, 1) corresponding to N time domain signals picked up by N microphones that form a microphone array, where N is an integer of 2 or more, f is a frequency index, and 1 is a frame index;

obtaining eigenvectors $v_1(f), \ldots v_M(f)$ of the correlation matrix, where M is an integer of 2 or more and not more than N; and determining $t_i(f), \ldots t_M(f)$ that satisfy a relationship of:

$$Y(f, l) = [v_1(f), \cdots, v_M(f)]\begin{bmatrix} t_1(f) \\ \vdots \\ t_M(f) \end{bmatrix}, \quad \text{[Formula 46]}$$

where Y(f,1)=[y(f,1+1), . . . , y(f,1+L)], L being an integer of 2 or more;

$$\begin{bmatrix} u_1(f) \\ \vdots \\ u_M(f) \end{bmatrix} = D(f)\begin{bmatrix} t_1(f) \\ \vdots \\ t_M(f) \end{bmatrix} \quad \text{[Formula 47]}$$

determining a matrix D(f) that is not a zero matrix, wherein the matrix D(f) makes $u_i(f), \ldots, u_M(f)$ defined by an expression above sparse in a time direction;

determining $c_{i,1}(f), \ldots, c_{M,N}(f)$ that satisfy a relationship of:

$$[c_1(f), \ldots, c_M(f)] = [v_1(f), \ldots, v_M(f)]D^{-1}(f)\ c_i(f) = [c_{i,1}(f), \ldots, c_{i,N}(f)]^T i = 1, \ldots, M \quad \text{[Formula 44]}$$

outputting $c_1(f)/c_{1j}(f), \ldots, c_M(f)/c_{Mj}(f)$ as a relative transfer function, where j is an integer of 1 or more and not more than N; and extract targeted audio data from an input audio received from the N microphones according to the relative transfer function.

5. The transfer function estimation method according to claim 4, wherein the determining the $t_i(f), \ldots, t_M(f)$ further comprises determining a matrix D(f) that minimizes $|u_1(f)|_1 + \ldots + |u_M(f)|_1$, in a condition in which diagonal elements of the matrix D(f) are fixed to a predetermined value.

6. The transfer function estimation method according to claim 4, wherein, where $A^H$ is a Hermitian matrix of a matrix A, $I_M$ is an M×M unit matrix, ||ti(f)||2 is an L2 norm of $t_i(f)$, and $t_{ni}(f) = t_i(f)/\|t_i(f)\|_2$, where i=1, . . . , M, and the method further comprising:

determining a matrix A that minimizes $|u_1(f)|_1 + \ldots + |u_M(f)|_l$ and that satisfies a following condition:

$$\begin{bmatrix} u_1(f) \\ \vdots \\ u_M(f) \end{bmatrix} = A\begin{bmatrix} t_{n1}(f) \\ \vdots \\ t_{nM}(f) \end{bmatrix} \quad \text{[Formula 52]}$$
$$A^H A = I_M;$$

and determining a matrix D(f) defined by a following expression:

$$D(f) = A\begin{bmatrix} 1/\|t_1(f)\|_2 & 0 & 0 \\ 0 & \ddots & 0 \\ 0 & 0 & 1/\|t_M(f)\|_2 \end{bmatrix}, \quad \text{[Formula 53]}$$

using the determined matrix A.

7. A computer-readable non-transitory recording medium storing a computer-executable program instructions that when executed by a processor cause a computer system to:

determine a correlation matrix of N frequency domain signals y(f, 1) corresponding to N time domain signals picked up by N microphones that form a microphone array, where N is an integer of 2 or more, f is a frequency index, and 1 is a frame index;

obtain eigenvectors $v_1(f), \ldots, v_M(f)$ of the correlation matrix, where M is an integer of 2 or more and not more than N;

determine $t_i(f), \ldots, t_M(f)$ that satisfy a relationship of:

$$Y(f, l) = [v_1(f), \cdots, v_M(f)]\begin{bmatrix} t_1(f) \\ \vdots \\ t_M(f) \end{bmatrix}, \quad \text{[Formula 49]}$$

where Y(f,1)=[y(f,1+1), . . . , y(f,1+L)], L being an integer of 2 or more;

$$\begin{bmatrix} u_1(f) \\ \vdots \\ u_M(f) \end{bmatrix} = D(f)\begin{bmatrix} t_1(f) \\ \vdots \\ t_M(f) \end{bmatrix} \quad \text{[Formula 50]}$$

determine a matrix D(f) that is not a zero matrix, wherein the matrix D(f) makes $u_i(f), \ldots, u_M(f)$ defined by an expression above sparse in a time direction;

determine $c_{i,1}(f), \ldots, c_{M,N}(f)$ that satisfy a relationship of:

$$[c_1(f), \ldots, c_M(f)] = [v_1(f), \ldots, v_M(f)]D^{-1}(f) \quad c_i(f) = [c_{i,1}(f), \ldots, c_{i,N}(f)]^T i = 1, \ldots, M \quad \text{[Formula 51]}$$

output $c_1(f)/c_{1,j}(f), \ldots, c_M(f)/c_{M,j}(f)$ as a relative transfer function, where j is an integer of 1 or more and not more than N; and extract targeted audio data from an input audio received from the N microphones according to the relative transfer function.

8. The computer-readable non-transitory recording medium according to claim 7, wherein the determining the $t_i(f), \ldots, t_M(f)$ further comprises determining a matrix D(f) that minimizes $|u_1(f)|_1 + \ldots + |u_M(f)|_1$, in a condition in which diagonal elements of the matrix D(f) are fixed to a predetermined value.

9. The computer-readable non-transitory recording medium according to claim 7, wherein, where $A^H$ is a Hermitian matrix of a matrix A, $I_M$ is an M×M unit matrix, $\|t_i(f)\|_2$ is an L2 norm of $t_i(f)$, and $t_{ni}(f) = t_i(f)/\|t_i(f)\|_2$, where i=1, . . . , M, and the computer-executable program instructions when executed by a processor further cause a computer system to:

determine a matrix A that minimizes $|u_1(f)_1 + \ldots + |u_M(f)|_l$ and that satisfies a following condition:

$$\begin{bmatrix} u_1(f) \\ \vdots \\ u_M(f) \end{bmatrix} = A\begin{bmatrix} t_{n1}(f) \\ \vdots \\ t_{nM}(f) \end{bmatrix} \quad \text{[Formula 54]}$$

$$A^H A = I_M,$$

and determine a matrix D(f) defined by a following expression:

$$D(f) = A\begin{bmatrix} 1/\|t_1(f)\|_2 & 0 & 0 \\ 0 & \ddots & 0 \\ 0 & 0 & 1/\|t_M(f)\|_2 \end{bmatrix}, \quad \text{[Formula 55]}$$

using the determined matrix A.

* * * * *